US005653057A

United States Patent [19]

Gary

[11] Patent Number: 5,653,057

[45] Date of Patent: Aug. 5, 1997

[54] SHUTTER ASSEMBLY

[76] Inventor: Anne Marie Gary, 2907 Yale Ct., Atlanta, Ga. 30339

[21] Appl. No.: 593,130

[22] Filed: Feb. 1, 1996

[51] Int. Cl.[6] ..... E05B 65/04

[52] U.S. Cl. ..... 49/67

[58] Field of Search ..... 49/61, 63, 67; 160/210, 213; 248/205.2; 292/DIG. 15; 16/382

[56] References Cited

U.S. PATENT DOCUMENTS

| | | | |
|---|---|---|---|
| 2,244,432 | 6/1941 | Schwab | 189/79 |
| 2,603,822 | 7/1952 | Evans | 49/67 |
| 2,716,785 | 9/1955 | Schoen | 49/67 |
| 3,183,547 | 5/1965 | Bury | 49/67 |
| 3,913,655 | 10/1975 | Ogino | 169/84 |
| 4,100,957 | 7/1978 | Shelton | 160/368 |
| 4,249,589 | 2/1981 | Loeb | 169/368 |
| 4,836,265 | 6/1989 | Bussert | 160/354 |
| 4,867,222 | 9/1989 | Roman et al. | 160/89 |
| 5,025,848 | 6/1991 | Prochaska | 160/368 |
| 5,097,886 | 3/1992 | Moyet-Ortiz | 160/368 |
| 5,158,127 | 10/1992 | Schumacher | 160/84.1 |
| 5,271,449 | 12/1993 | Herrick | 160/368.1 |
| 5,323,835 | 6/1994 | Bachmeier | 160/89 |
| 5,361,552 | 11/1994 | Fulford | 52/455 |
| 5,390,975 | 2/1995 | Stephens | 296/211 |

*Primary Examiner*—Kenneth J. Dorner
*Assistant Examiner*—Curtis Cohen
*Attorney, Agent, or Firm*—Stephen R. Risley; Thomas, Kayden, Horstemeyer & Risley

[57] ABSTRACT

A shutter assembly comprising at least one generally rectangular shutter constructed and arranged to be removably attached to the window jambs and bottom sill of a window opening for covering a window is disclosed. The shutter assembly is attached to and pivotally supported on the jambs of the window opening by a plurality of hook-and-loop hinges and is held in a closed position on the window opening by a plurality of hook-and-loop closure assemblies. The shutter or shutters of the assembly are generally made of cardboard, and include a photo-image of a wooden shutter on the outwardly and inwardly facing surfaces of the shutter.

10 Claims, 3 Drawing Sheets

SHUTTER ASSEMBLY

FIELD OF THE INVENTION

The invention relates in general to shutter assemblies for use with windows. More particularly, this invention relates to an inexpensive shutter assembly including at least one simplified shutter, and a simple method of mounting the shutter for use in a window opening.

BACKGROUND OF THE INVENTION

Window coverings can be a major expense for residents of apartments and houses. Draperies, in particular, are an expense which an apartment renter may not wish to incur, and a new homeowner may not be able to incur after purchasing a home. Shutters or blinds can be a less expensive alternative, but yet still may be too expensive for renters and/or recent home buyers. Regardless of the expense, it is desirable for either a new renter or homeowner to cover the windows immediately upon moving into a dwelling not only for the purposes of appearance and privacy, but also for security in order to deter potential burglars from viewing the possessions housed within the dwelling or structure.

Thus, there exists a need for a temporary window covering that may be installed immediately upon moving into an apartment or house, but yet which is durable enough to last in use for an indefinite period of time until the renter or homeowner installs a more permanent window covering. The temporary window covering should preferably be durable enough to last for at least the period of time, for example a year or two, that a person renting an apartment or house may occupy the dwelling.

The above discussed problems have been solved in the past by people hanging newspapers, sheets, or similar window coverings over the windows to limit the view therethrough. However, such temporary solutions are inconvenient, are lacking in aesthetics, and are generally not durable enough to provide a meaningful window covering alternative. Thus the need exists for an inexpensive, easy to install, and attractive shutter assembly constructed for use on a temporary or permanent basis by college students, renters, and homeowners, as well as being adapted for use on summer cottages, commercial buildings, new homes, and in garage and storage building windows.

SUMMARY OF THE INVENTION

In accordance with the present invention, a shutter assembly is provided which includes a shutter assembly having at least one shutter, and more generally a pair of shutters, constructed and arranged for easy attachment in a conventional window opening. The individual shutter or shutters are made of cardboard, particle board or other similar yet inexpensive materials, and thus are lightweight and relatively inexpensive when compared to the known wood or vinyl shutters. In addition, the shutters of this invention are manufactured so that they can be easily cut to fit the size of the window openings defined within the structure. The shutter assembly includes a plurality of hinges and brackets for hanging the shutters within the window openings, preferably in an easily removable fashion. A photo-image of a wooden shutter, and/or of a landscape, is included on the inwardly facing side of the shutter, and a photo-image of a wooden shutter is included on the outwardly facing side of the shutter.

Accordingly, it is an object of the present invention to provide a shutter assembly for use in temporarily or permanently providing privacy for the dwelling or other structure on which the invention is used.

Another object of this invention is to provide a shutter assembly which can be quickly and easily installed in any size window opening.

Yet another object of the present invention is to provide a shutter assembly which is quickly and easily assembled and installed for use.

Still another object of the invention is to provide a shutter assembly which provides privacy and security for the occupants of a dwelling without compromising on aesthetic appearances.

It is also an object of the invention to provide an improved shutter assembly which is simple in design and operation, is inexpensive to construct, and is durable and rugged in structure.

Thus, these and other objects, features, and advantages of the invention will become apparent upon reading the specification when taken in conjunction with the accompanying drawings, wherein like characters of reference designate corresponding parts throughout the several views.

DETAILED DESCRIPTION

Figure 1:
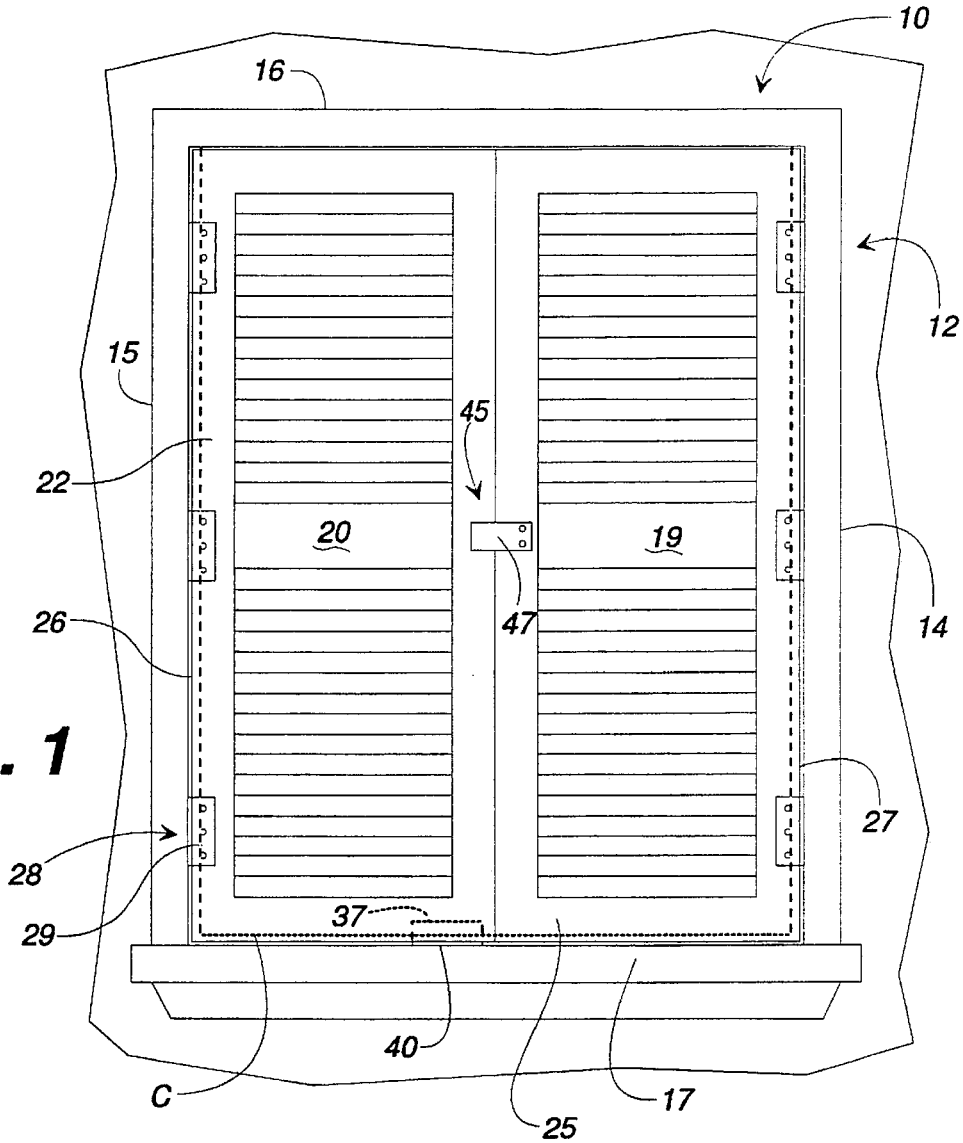
FIG. 1 is a front elevational view of the interior surface a preferred embodiment of the shutter assembly installed within a window opening.

Referring now in detail to the drawings, in which like characters of reference indicate like parts throughout the several views, FIG. 1 illustrates a shutter assembly 10 installed over a window 11 (FIG. 3) positioned within a window opening 12 of a conventional dwelling or structure (not illustrated). Window opening 12 is generally rectangular in shape, and is defined within the sidewall 13 of a dwelling or structure (not illustrated) by a pair of spaced and generally vertical window jambs, right jamb 14 and left jamb 15, tied into a generally horizontal top header 16, spaced above a generally horizontal bottom window sill 17. Window sill 17 may also be known as a window stool to those skilled in the art. Window 11 may be any conventional window, to include a double hung window with an upper sash and a lower sash, as well as a window having only a single sash, for example, a casement window.

Shutter assembly 10 is preferably attached to the inside jambs 14, 15 of window opening 12, and secured in a closed position on the window opening, best shown in FIG. 1, by being secured to window sill 17, all as discussed in greater detail below. Shutter assembly 10 is so constructed and mounted within window opening 12 that it may be positioned on the window opening in a closed position (FIG. 1) and moved into an open position, as shown generally in FIGS. 3, 4, and 6. In the alternative, it is anticipated that the shutter assembly can be fastened directly to the walls (not illustrated) surrounding the window opening, rather than to the window jambs and sill.

Figure 3:
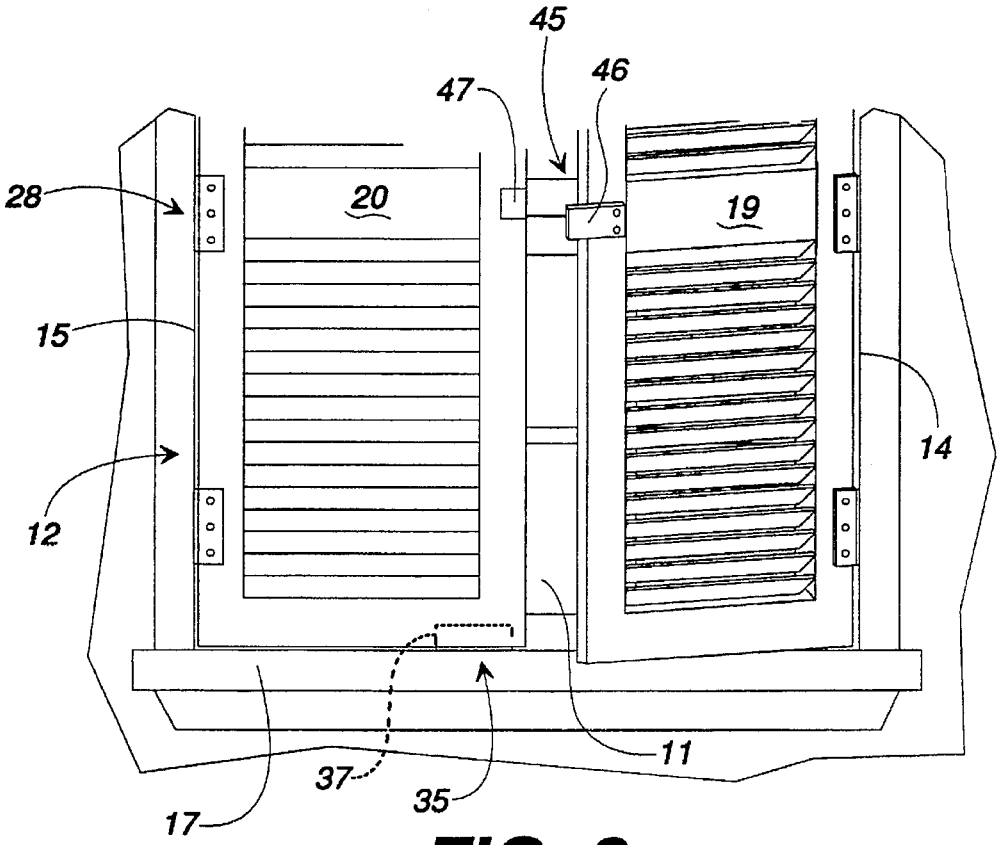
FIG. 3 is a partial perspective view, from inside a structure or dwelling, of the shutter assembly of FIG. 1 illustrating the shutter closure assembly and latch assembly used to secure the shutters in a closed position on a window.
Figure 4:
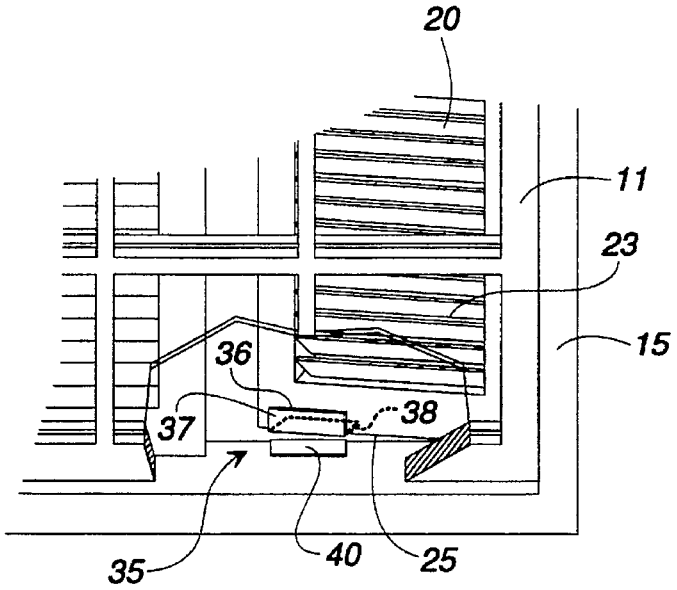
FIG. 4 is a partially cutaway perspective view, from outside a structure or dwelling, of the shutter closure assembly of FIG. 3.
Figure 5:
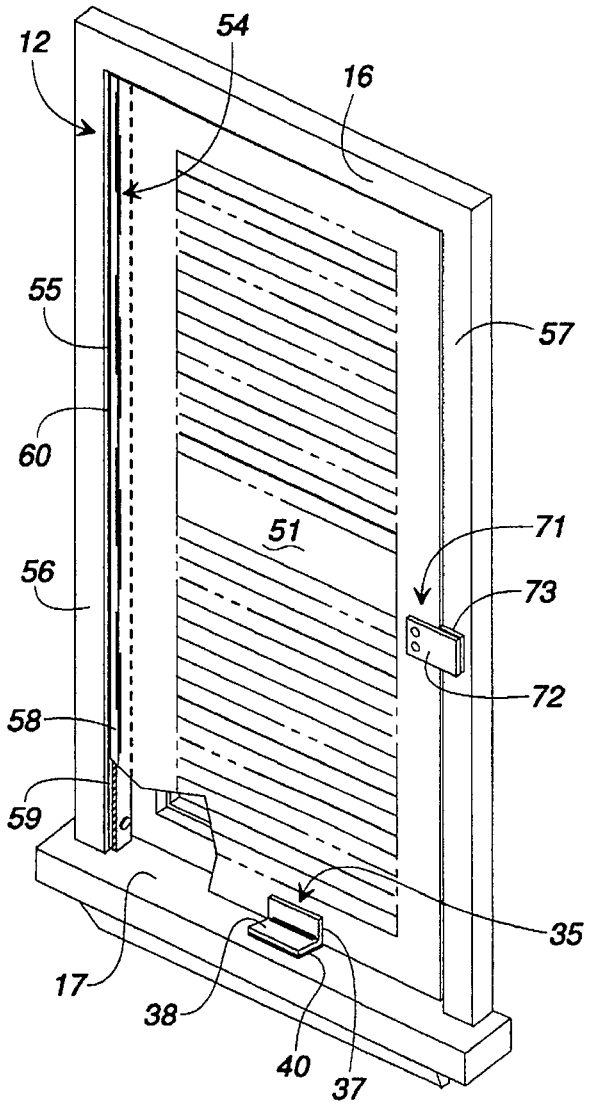
FIG. 5 is a front elevational view, in partial perspective, of a second embodiment of the shutter assembly.
Figure 6:
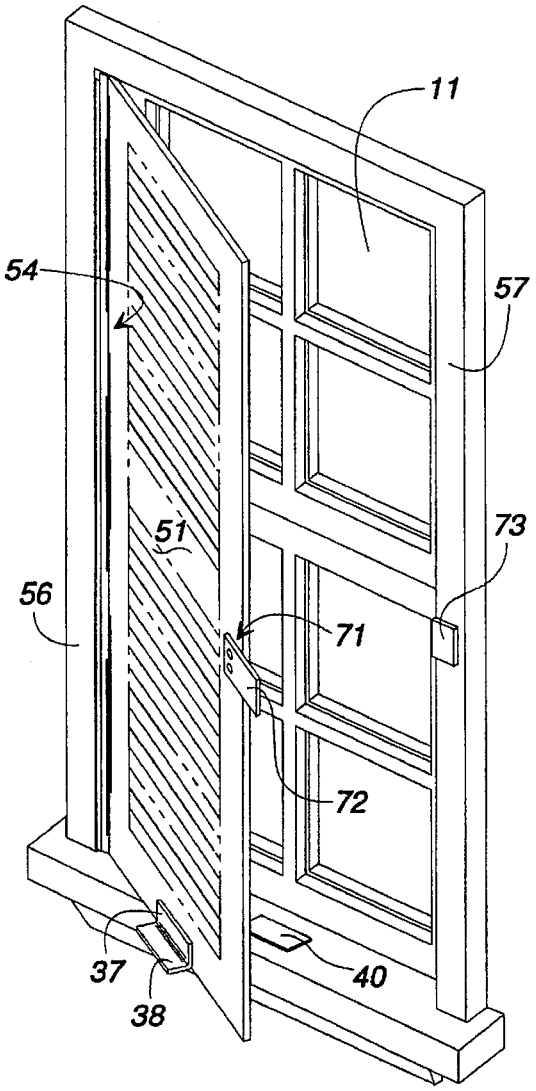
FIG. 6 is a front perspective view of the shutter assembly of FIG. 5 shown in an open position on a window.

A first embodiment of shutter assembly 10 includes a pair of opposed shutters, a first shutter 19 and a second shutter 20, which are of sufficient shape and size to generally cover the entire expanse of window 11. Although a pair of shutters 19, 20 are shown in FIGS. 1, 3, and 4, it is anticipated that a single shutter 51, as shown in FIGS. 5 & 6, may also be used to cover window 11. Moreover, it is also anticipated that more than one pair of shutters 19, 20 can be used. For example, two pairs of shutters, one for each sash (not illustrated) of a double hung window (not illustrated) can be used, depending on the size and design of the window.

Each of shutters 19 & 20 (FIG. 1) and 51 (FIG. 5) is substantially planar and rectangular, and is preferably constructed of a rigid, durable, pressed paper product such as cardboard. It is anticipated, however, that shutters 19, 20, and 51 could also be constructed of particleboard, pressboard, styrofoam, or any other inexpensive, yet durable material with generally hard and smooth exterior surfaces. The material used to construct the shutters must be durable enough and of sufficient thickness to be substantially self-supporting in window opening 12.

Turning to FIG. 1 each shutter 19, 20 has a front or interior surface 22 which faces inwardly toward the inside of the room of the structure or dwelling on which shutter assembly 10 is used, and a rear or exterior surface 23 (FIG. 4) which faces outwardly of window 11 through window opening 12. Each of shutters 19 and 20 has a generally horizontal bottom edge 25 adjacent window sill 17, and a pair of generally vertical side edges 26, 27 adjacent window jambs 14, 15, respectively. Shutters 19, 20 will come sized in a number of standard shapes and sizes corresponding to standard window sizes. However, if a shutter blank for shutters 19, 20 will not fit the window opening 12 into which the shutters are being installed, it is anticipated that shutters 19, 20, as well as shutter 50, will be cut with a utility knife, for example, or any other suitable cutting tool so that the shutters are sized to fit inside window opening 12. Thus, in a preferred embodiment, a cutting allowance, designated by the ghost lines labeled "C" in FIG. 1, is provided along bottom edge 25 and side edges 26 and/or 27 of each shutter 19, 20, and along the bottom edge and side edges of shutter 51 if so desired, so that the shutters can be cut to the appropriate size needed to cover window 11.

Figure 2:
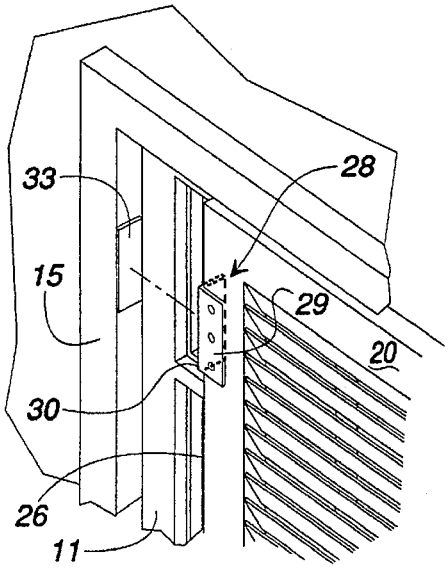
FIG. 2 is a partial perspective view showing a first embodiment of the hinge assembly of the shutter assembly shown in FIG. 1.

Shutters 19 and 20 are releasably attached to right window jamb 14 and left window jamb 15, on opposite sides of window opening 12, respectively by a plurality of hinges 28, here three per shutter, attached to side edges 26, 27 of the shutters and to window jambs 14, 15 of the window opening, respectively. In a first embodiment, hinges 28 are each attached separately to shutters 19, 20, as shown in FIG. 1, and received on one each of a plurality of tabs 33 mounted on the right and left window jambs, respectively. More specifically, three spaced hinges 28 are attached to the interior surface 22 of a shutter, as shown in FIGS. 1 and 2. Hinges 28 are separately folded over side edges 26 and 27, respectively, to form two portions, a first portion 29 attached to the interior surface 22 and along the side edge of the shutter, and a second portion 30 which wraps around the side edges 26, 27 of shutters 19, 20 at a right angle with respect to first portion 29, as illustrated generally in FIG. 2. First portion 29 is attached to interior surface 22 of shutters 19, 20 with an adhesive, or may be attached to the interior surface with a conventional fastener, for example, by nails, screws, or tacks. Each of hinges 28 here is a hook-and-loop type fastener such as a VELCRO® fastener, for example. It is anticipated that only second portion 30 of hinge 28 need comprise a hook-and-loop type fastener, as only second portion 30 of the hinge is folded over and positioned on one of side edges 26, 27 facing toward one of tabs 33.

Tab 33, as shown in FIG. 2, is also a hook-and-loop type fastener of substantially the same size as second portion 30 of the hinge. Tabs 33 are attached to the window jambs of window opening 12, as shown in FIG. 2, in substantial alignment with each respective second portion 30 by gluing the tab to the jambs, or by nailing, tacking, or otherwise securing the tab to the window jamb. It is anticipated that first portion 29 and second portion 30 of hinge 28, as well as tab 33 may each be provided with an adhesive backing for mounting on shutters 19, 20, as well as window jambs 14, 15, respectively.

Tab 33 and the second portion 30 of the hinge, each being a hook-and-loop type fastener, will be fastened to one another and thus function to removably support each of shutters 19, 20 in the window opening, but yet allow the shutters to swing open (FIG. 3) and shut (FIG. 1) in the window opening. Although shutters 19 and 20 are shown in FIGS. 1–4 as being supported by three hinges 28 along each side edge 26 and 27, it is appreciated by those familiar with the art that either a greater or lesser number of hinges 28 may be used for each of the shutters.

The manner of closing shutters 19, 20, as well as shutter 51 on window opening 12 is illustrated in FIGS. 3, 4, and 5. Each of shutters 19, 20, and 51 can be placed in a closed position on window 11 with respect to window opening 12, and fastened in the closed position on window sill 17 by a closure assembly 35 comprised of a first tab 36 mounted at the bottom edge 25 of each of the shutters, and a second tab 40 mounted on window sill 17. Tab 36 is a rectangular piece of a hook-and-loop type fastener folded to form two portions, a first portion 37 fastened to the exterior surface 23 of the shutter, and a second portion 38 folded at a right angle with respect to bottom edge 25 of the shutter facing toward window sill 17. Second portion 38 may extend at a right angle over bottom edge 25, or at a right angle away from bottom edge 25, but in either instance parallel to window sill 17. Second portion 38 is preferably a hook-and-loop type fastener constructed and arranged to mate with second tab 40, also a hook-and-loop type fastener, tab 40 being attached to window sill 17 in alignment with first portion 37. It is also possible that first portion 37 will be a hook-and-loop type fastener, adapted for attachment to second tab 40. A closure assembly 35 is separately provided for each one of the shutters, and thus, for example, first shutter 19 can be maintained in a closed position on window 11 even if second shutter 20 is left open to permit the passage of light or fresh air into the room.

The embodiment of shutter assembly 10 shown in FIGS. 1–4 also includes a latch assembly 45 for keeping both of shutters 19, 20 in a closed position on window 11. The latch assembly includes a latch plate 46 attached to the interior surface of one of shutters 19, 20 by an adhesive or mechanical fastener. A corresponding strike plate 47 is attached to the interior surface of one of shutters 19, 20 opposite that on which latch plate 46 is mounted. Both latch plate 46 and strike plate 47 comprise a hook-and-loop type fastener, for example one made of VELCRO®, for attaching the latch plate 46 to the strike plate 47.

In a second embodiment of the shutter assembly, shown in FIGS. 5 and 6, a single shutter 51 is fastened by an elongated hinge 54 formed along side edge 55 of the shutter to a window jamb 56 of a window opening 12 for a window 11. Unlike the first embodiment of FIGS. 1–4, having three separate hinges 28, the embodiment of window treatment shutter assembly shown in FIGS. 5 and 6 has only a single and elongated hinge 54 formed along generally vertical side edge 55 of shutter 51 adjacent window jamb 56. Hinge 54 can best be likened to a piano hinge, and can be constructed as a conventional piano hinge if so desired. Here it is anticipated, however, that the hinge 54 will be constructed of two elongated tabs, a first tab 58 and a second tab 59, joined to one another along a prescored or creased folding line 60 along the length of the tabs. Each of tabs 58 and 59 may also include a single linen tape glued to each of the shutter tabs and spanning across the "crease" portion of the hinge to reinforce hinge 54 as well as improving hinge service life.

Tab 58 will be glued or mechanically fastened at intervals along window jamb 56, whereas tab 59 is formed as an integral part of shutter 51, and may only be a designated portion of shutter 51 along side edge 55 rather than a separate tab as such. Once tab 58 is glued or fastened to the window jamb, shutter 51 may be moved into a closed position on window 11 by bending shutter 51 along prescored line 60, as shown in FIG. 5, and secured in the closed position on the window by closure assembly 35, constructed and installed for shutter 51 in the same manner as is closure assembly 35 for shutters 19 and 20. Shutter 51 may also be provided with a latch assembly 70, again constructed and installed for shutter 51 in the same manner as is latch assembly 45 for shutters 19 and 20, with the exception that strike plate 71 will be mounted on window jamb 57, rather than on a shutter. Latch plate 73 is thus received on strike plate 72 to "lock" shutter 51 in its closed position.

Each of tabs 58 and 59 will be fabricated of the same material used to make shutter 51, it being anticipated that each is made of cardboard or of a similar finished paper product. As with shutters 19 and 20, however, shutter 51 and hinge 54 may just as well be made from particleboard, pressboard, styrofoam, or any other inexpensive, yet durable material with generally hard and smooth exterior surfaces. Closure assembly 35 and latch assembly 71 are each comprised of hook-and-loop VELCRO® type fasteners, as discussed above for closure assembly 35 and latch assembly 45 of shutters 19 and 20. In addition, the shutter assembly including shutter 51 may also include self adhesive decals resembling a conventional hinge, for attachment to interior surface 52 of shutter 51 along side edge 55.

In yet another embodiment of shutter 51, although not illustrated herein, the shutter may be attached to top header 16 of window opening 12 using an elongated hinge 54 as described above, so that shutter 51 is opened like a Bermuda shutter to let light and/or fresh air enter the room. So constructed, shutter 51 would pivot on top header 16 so that the opposed sides and bottom of the shutter move in a generally upward direction away from window 11, and a separately provided stick or rod used to prop the shutter open.

For aesthetic appeal, the shutters may include a design embossed thereon (not illustrated), or can have a photo image of a wooden shutter laminated thereon (FIG. 1) on one or both sides. In addition, the photo image of a wooden shutter could comprise an image of two side by side shutters (not illustrated), for example, for use on a single shutter similar to shutter 51 of FIG. 5, placed in the window opening. Moreover, the photo image of the shutters could show panelled shutters (not illustrated), instead of louvered shutters. The photo image on the interior side of the shutters can alternatively comprise a landscape or other pictorial scene as if seen through partially closed shutters, shown generally in FIGS. 5 and 6. Also, shutters 19, 20 of FIGS. 1–4, and shutter 51 of FIGS. 5 and 6, can be installed to cover only a part of a window opening, for example the lower sash of a double hung window, or to cover the entire window opening.

The shutter assembly disclosed herein may be sold as a kit at home improvement stores and the like. The kit can include either a single shutter 51 (FIG. 5), or a pair of shutters 19, 20 (FIG. 1) of standard sizes. Various kits can include shutters of different sizes, colors, and designs. The shutter assembly will also include a number of hinges 28 and corresponding tabs 33, a single shutter closure assembly 35, as well as a single latch assembly 45, for a pair of shutters 19, 20; and include an integral hinge 54, closure assembly 35, and catch assembly 71 for shutter 51.

While preferred embodiments of the invention have been disclosed in the foregoing specification, it is understood by those skilled in the art that variations and modifications thereof can be made without departing from the spirit and scope of the invention, as set forth in the following claims. Also, the corresponding structures, materials, acts and equivalents of any means or step plus function elements in the claims below are intended to include any structure, material, or acts for performing the functions in combination with other claimed elements as specifically claimed.

I claim:

1. A shutter assembly for covering a window positioned in the sidewall of a room within a dwelling or other structure, the window being supported within a window opening defined in the sidewall by at least one generally vertical window jamb, a generally horizontal top header, and a spaced bottom window sill, said shutter assembly, comprising:

at least one shutter, said shutter having an inwardly facing interior surface and an outwardly facing exterior surface;

hinge means for pivotally attaching said at least one shutter to the window opening, wherein said hinge means comprises a hinge having a first portion mounted on said interior surface at a side edge of said at least one shutter, a second portion folded over said edge with respect to said first portion and facing toward the window opening, and a tab constructed and arranged to receive said second portion thereon mounted on the window opening in substantial alignment with said second portion; wherein said second portion of said hinge means and said tab of said hinge means comprises a hook-and-loop fastener, closure means for securing said at least one shutter in a closed position on the window sill, said closure means comprising a first tab mounted on said at least one shutter, said first tab having a first portion attached one shutter, said first portion is attached to said interior surface of said shutter at a bottom edge thereof and a second portion extending at a right angle with respect to said first portion, and a second tab mounted on the window sill adjacent said first tab constructed and arranged to receive said first tab thereon for holding said at least one shutter in said closed position; and wherein said second tab and the second portion of said first tab comprise a hook-and-loop fastener, at least one of said interior and exterior surfaces of said at least one shutter comprising a photo-image of a wooden shutter.

2. The shutter assembly of claim 1, wherein said second portion of said closure means and said second tab of said closure means each comprises a hook-and-loop fastener.

3. The shutter assembly of claim 1, wherein said hinge means comprises a hinge having a first elongated tab extending along a side edge of said at least one shutter, said first elongated tab being fastened to said side edge of said shutter along a prescored folding line, said first tab being constructed and arranged to be mounted directly to the window opening in which said at least one shutter is placed.

4. The shutter assembly of claim 3, wherein said hinge is comprised of cardboard.

5. The shutter assembly of claim 1, wherein said at least one shutter is comprised of cardboard.

6. The shutter assembly of claim 1, comprising latch means for latching said at least one shutter in said closed position on the window opening.

7. A shutter assembly for covering a window positioned in the sidewall of a room within a dwelling or other structure, the window being supported within a generally rectangular window opening defined in the sidewall by a spaced pair of generally vertical window jambs, a generally horizontal top header, and a spaced bottom window sill, said shutter assembly comprising:

a first shutter and a second shutter, each of said shutters having an inwardly facing interior surface and an outwardly facing exterior surface;

hinge means for pivotally attaching each of said shutters to one each of the window jambs, wherein said hinge means comprises a hinge having a first portion mounted on said interior surface at a side edge of said at least one shutter, a second portion folded over said edge with respect to said first portion and facing toward the window jamb, and a tab constructed and arranged to receive said second portion thereon mounted on the window jamb in substantial alignment with said second portion; wherein said second portion of said hinge means and said tab of said hinge means comprises a hook-and-loop fastener, closure means for securing said shutters in a closed position on the window opening, said closure means comprising a first tab mounted on each said shutter, said first tab having a first portion attached to said interior surface of each said shutter at a bottom edge thereof and a second portion extending at a fight angle with respect to said first portion, and a second tab mounted on the window sill adjacent said first tab constructed and arranged to receive said first tab thereon for holding each said shutter in said closed position; and wherein said second tab and the second portion of said first tab comprise a hook-and-loop fastener, hook-and-loop latch means for latching said first shutter to said second shutter and for securing said shutters in said closed position on the window opening.

8. The shutter assembly of claim 7, wherein said second portion of said closure means and said second tab of said closure means each comprises a hook-and-loop fastener.

9. The shutter assembly of claim 7, said latch means comprising a latch plate attached to said interior surface of one of said shutters and a strike plate attached to said interior surface of the other of said shutters in substantial alignment with said latch plate, said latch plate and said strike plate each comprising a hook-and-loop fastener constructed and arranged to mate with one another for latching said first shutter to said second shutter in said closed position on the window opening.

10. The shutter assembly of claim 7, wherein said first shutter and said second shutter are each comprised of cardboard.

* * * * *